United States Patent [19]

Sanford et al.

[11] Patent Number: 4,923,007

[45] Date of Patent: May 8, 1990

[54] INFLATABLE PACKER WITH IMPROVED REINFORCING MEMBERS

[75] Inventors: Lawrence Sanford; Charles O. Stokley, both of Houston, Tex.

[73] Assignee: Tam International, Houston, Tex.

[21] Appl. No.: 272,238

[22] Filed: Nov. 15, 1988

[51] Int. Cl.[5] ..... E21B 33/127

[52] U.S. Cl. ..... 166/187; 277/34

[58] Field of Search ..... 166/187, 387; 277/34, 277/34.6; 403/97, 105; 285/107, 109, 236, 258, 370, 373; 92/193, 201

[56] References Cited

U.S. PATENT DOCUMENTS

| | | | |
|---|---|---|---|
| 2,778,432 | 1/1957 | Allen | 166/187 |
| 3,217,400 | 11/1965 | Illesy et al. | 285/107 X |
| 3,477,506 | 11/1969 | Malone | 166/207 |
| 3,529,667 | 9/1970 | Malone | 166/187 X |
| 3,581,816 | 6/1971 | Malone | 166/187 |
| 3,583,292 | 6/1971 | Garnier | 92/193 X |
| 3,604,732 | 9/1971 | Malone | 285/106 |
| 3,899,631 | 8/1975 | Clark | 166/187 X |
| 4,403,660 | 9/1983 | Coone | 166/387 |
| 4,492,383 | 1/1985 | Wood | 277/34 |
| 4,544,165 | 10/1985 | Coone | 277/34 |
| 4,711,455 | 12/1987 | Ditcher et al. | 285/230 X |
| 4,744,421 | 5/1988 | Wood et al. | 166/387 |
| 4,768,590 | 9/1988 | Sanford et al. | 166/187 |

FOREIGN PATENT DOCUMENTS

| | | | |
|---|---|---|---|
| 452063 | 10/1948 | Canada | 285/258 |

OTHER PUBLICATIONS

Inflatable Packer Systems Marine Tools, 1978–1979 General Catalog Tam International, 10 pages.

"Tamcap Inflatable Cementing Packers", Copyright 1986 by Tam International, Inc., 7 pages.

*Primary Examiner*—William P. Neuder

*Attorney, Agent, or Firm*—Browing, Bushman, Anderson & Brookhart

[57] ABSTRACT

An inflatable packer is provided for setting downhole in an oil or gas well to prevent fluid flow past the packer. The packer is of the type which includes an upper and lower packer head, an inflatable elastomer bladder, a radially outward tubular packer cover, and a plurality of overlapping metal reinforcing members positioned in the annulus between the bladder sleeve and the tubular packer cover. Each reinforcing member is slidably movable relative to another reinforcing member during setting of the packer, and includes a stop member between the packer heads for limiting to a preselected amount the relative sliding movement, such that gaps between reinforcing members are minimized or eliminated. These stop members on the reinforcing members may be formed by a stamping operation, wherein a recess stamped in one reinforcing member is adapted to receive a lip stamped in an adjacent reinforcing member. When the lip drops within the recess, further sliding movement between those reinforcing members is prohibited. Each of the reinforcing members preferably includes an interior surface substantially parallel to the outer surface of the bladder sleeve when the packer is inflated. The concepts of the present invention substantially reduce the likelihood of rupture of the bladder, thereby enhancing the reliability of an inflatable packer.

15 Claims, 2 Drawing Sheets

INFLATABLE PACKER WITH IMPROVED REINFORCING MEMBERS

BACKGROUND OF THE INVENTION

1. Field of the Invention

The present invention relates to inflatable packers and, more particularly, relates to inflatable packers of the type having overlapping reinforcing members in an annulus between an inner elastomeric bladder and an outer packer cover. The packer of the present invention is commonly used to seal across downhole conduits, such as well casings, when the packer cover is expanded to its inflated or set condition.

2. Description of the Prior Art

Inflatable packers which comprise an inner elastomeric bladder, an outer elastomeric packer cover, and a plurality of metal reinforcing members in the annulus between the bladder and the packer cover have long been used in the oil and gas industry. A tubular mandrel is typically disposed within the inner elastomeric bladder, with an upper packer head fixedly connected to one end of the mandrel and the lower packer head longitudinally slidable on the mandrel to accommodate radial expansion of the bladder, the reinforcing members, and the packer cover when the packer is inflated.

Those familiar with packers have long recognized that the possibility of bladder rupture is a significant, if not most important, drawback to downhole inflatable packers. The sleeve-like bladder or bladder defines a chamber which retains the pressurized fluid which is used to inflate the packer, while the elastomeric body seals against the casing or other downhole conduit, and thus prohibits fluid flow past the packer when in its set or inflated condition. In order to provide sufficient strength to reliably seal across the casing over a long period of time and/or seal high temperature fluids, inflatable packers have long been provided with reinforcing members, such as braded metal cords or overlapping metal strips, which are positioned in the annulus between the bladder and the packer cover.

While metal reinforcing members decrease the likelihood of packer failure under certain conditions, inflatable packers continue to experience rupture problems, particularly when packers have high expansion ratios between the "run in" and "set" positions. The packer must frequently be run into a well through a string of relatively small diameter tubing and, after emerging therefrom, be able to seal against a larger diameter well casing. The expansion ratio between the relaxed outer diameter of the packer cover and the diameter of the inflated packer cover sealed against the casing may be in excess of two hundred percent. Accordingly, the material for the elastomeric bladder and the packer cover must be properly selected so that the likelihood of packer failure is minimized.

The elastomeric bladder of the packer often ruptures in the vicinity of the packer heads, where radial expansion of the bladder and the packer cover is generally unsupported, i.e., the expanded packer cover is not in engagement with the sidewalls of the well. Over-lapping metal reinforcing members at these positions tend to separate, and gaps may thus occur between the reinforcing members. The expanding bladder radially interior of these reinforcing members becomes thinner as the packer expansion continues, so that the thinner bladder may extrude at one or more circumferential locations into the gaps between the reinforcing members.

Accordingly, failure or rupture of the packer bladder is likely to occur when a portion of the bladder extrudes through the gap between reinforcing members during or after the packer setting operation, and most often in a packer designed to have a high expansion ratio (must pass downhole through the small diameter tubing yet seal against the much larger diameter casing). As suggested above, this rupture may not occur immediately upon extrusion of the bladder through the gap, but rather may occur after the packer has been in use for some time. This condition only further increases the drawbacks of an inflatable packer, since the operator may set the packer and have reason to believe that the packer is properly sealed against the casing within the wellbore, only to discover days later that the packer has subsequently ruptured.

U.S. Pat. No. 4,768,590 discloses an inflatable packer which has significant advantages over prior art packers. The bladder or bladder of the packer is "oversized" with respect to the packer cover, so that the outer diameter of the bladder in the relaxed state is substantially greater than the inner diameter of the packer cover in the relaxed state. In its deflated or relaxed condition, the bladder is folded upon itself, so that when the packer is inflated, a portion of the required increase in the diameter of the bladder is accommodated by unfolding of the bladder. Since the extent to which the bladder must stretch during inflation is reduced, the bladder is less likely to extrude between any small gaps provided between the reinforcing members.

While the technique described in the '590 patent represents a significant advancement over the prior art, some operators do not prefer to use a packer with a bladder which is folded over in its relaxed state. Moreover, even packers which include such a bladder occasionally experience failure problems, particularly when the packer is repeatedly used over an extended time period. Thus, the acceptance of inflatable packers in the oil and gas industry is still limited by the significant drawback previously discussed, namely the possibility that the bladder may rupture under conditions where the expansion of the packer is very large and/or when the packer is subjected to an elevated temperature over an extended time period.

The disadvantages of the prior art are overcome by the present invention, and an improved packer is hereinafter disclosed which may be reliably used to seal against a casing or other downhole conduit. The packer of the present invention is able to withstand elevated temperatures over extended time periods, and is able to be reliably used in situations where the packer must have a high expansion ratio between its run in and set conditions.

SUMMARY OF THE INVENTION

An inflatable packer according to the present invention includes an inner elastomeric bladder, an outer packer cover, and a plurality of overlapping sheet-like metal reinforcing members which are each positioned in the annulus between the bladder and the packer cover. The bladder, the reinforcing members, and the packer cover are each secured at one end to a packer head fixed to an inner mandrel, and are each secured at the other end to a packer head longitudinally movable with respect to the inner mandrel. Accordingly, the movable packer head axially moves toward the fixed packer head during expansion of the packer to accommodate the radially outward movement of the bladder, reinforcing members, and packer cover.

Each of the plurality of reinforcing members include a stop member, positioned axially between the packer heads, for limiting sliding or circumferential movement of adjacent reinforcing members relative to each other. During expansion of the packer, the reinforcing members may not uniformly expand, so that relative sliding movement between adjacent reinforcing members may readily occur on one side of the packer cover to accommodate radial expansion, while the radially opposing reinforcing members remain substantially stationary. Significant gaps between the reinforcing members are prevented, however, since the extent of sliding movement between adjacent reinforcing members is limited by one or more stop surfaces selectively positioned to prevent the formation of a gap between the expanding reinforcing members.

The interior surface of each of the reinforcing members in engagement with the outer surface of the bladder when the packer is in its inflated condition lies along a substantially tangential plane. This tangential surface is parallel with the outer bladder surface, thereby decreasing the likelihood of abrasion on the bladder and thus further decreasing the likelihood of packer failure.

In one preferred embodiment, each metal reinforcing member is fixed at each end to a respective packer head by a weld, with a second axially spaced weld securing each reinforcing member to another reinforcing member. Axial spacing of the welds which secure the ends of each reinforcing member to the packer head and to other reinforcing members favorably minimizes uneven movement of the reinforcing members, and increases the likelihood that overlapping reinforcing members will slide relative to each other substantially equal amounts during radial expansion of the packer.

In one embodiment of the invention, each sheet-like reinforcing member includes a recess or notch in its outer surface, and a ridge or lip projecting radially inward from its inner surface. The lip of one reinforcing member is in engagement with the outer surface of an adjacent reinforcing member when the packer is in its relaxed or run in state, and the lips slide along the outer surface of each adjacent reinforcing member as the packer expands. Once the sliding or circumferential movement of adjacent reinforcing members reaches its selected value, the lip falls within the recess of the adjacent reinforcing member, thereby stopping further sliding movement and preventing the formation of a gap between the reinforcing members. Once the lip of one reinforcing member engages the stop surface provided by the recess on an adjacent reinforcing member, continued radial expansion of the reinforcing members will occur by sliding movement between other reinforcing members whose stop surfaces have not yet contacted each other. Substantially uniform expansion of the reinforcing members thus prevents the formation of gaps between reinforcing members, and thereby minimizes the likelihood of bladder rupture. The inner surface of each of the reinforcing members may be honed to lie substantially within a tangential plane, so that the plurality of reinforcing members together form a generally cylindrical-shaped surface, which further minimizes the likelihood of wear or abrasion of the elastomeric bladder and thus further increases packer reliability.

It is an object of the present invention to provide a packer which includes a plurality of reinforcing members which each include stop surfaces carried thereon and spaced between the packer heads to limit sliding movement of each reinforcing member relative to its adjacent reinforcing member.

It is a further object of the present invention to provide an inflatable packer with reinforcing members wherein the inflatable bladder provided radially inward of the reinforcing members is less likely to rupture.

Still a further object of the invention is to provide a packer which may be inflated to a diameter substantially greater than its run in diameter, and which may be reliably maintained in its inflated position over an extended time period when exposed to elevated temperatures.

It is a feature of the present invention that the packer include sheet-like metal reinforcing members each with one or more stop surfaces for engagement with an adjoining reinforcing member.

It is a further feature of the present invention that the packer include metal reinforcing members each with one or more stop surfaces and an inflatable bladder or bladder which has an outer diameter substantially greater than the inner diameter of the packer cover during its relaxed position.

It is a further feature of the present invention that the reinforcing members may each include an inner surface lying within a substantially tangential plane, such that the tangential inner surface of each reinforcing member is substantially parallel with the outer surface of the bladder when the packer is in its inflated position.

An advantage of the present invention is that the reliability of the packer may be substantially increased and the likelihood of bladder rupture substantially decreased with a minimum increase in the packer cost.

It is a further advantage of the present invention that the packer include reinforcing members which may each be secured at each end to a respective packer head and to another reinforcing member by a pair of axially spaced welds.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
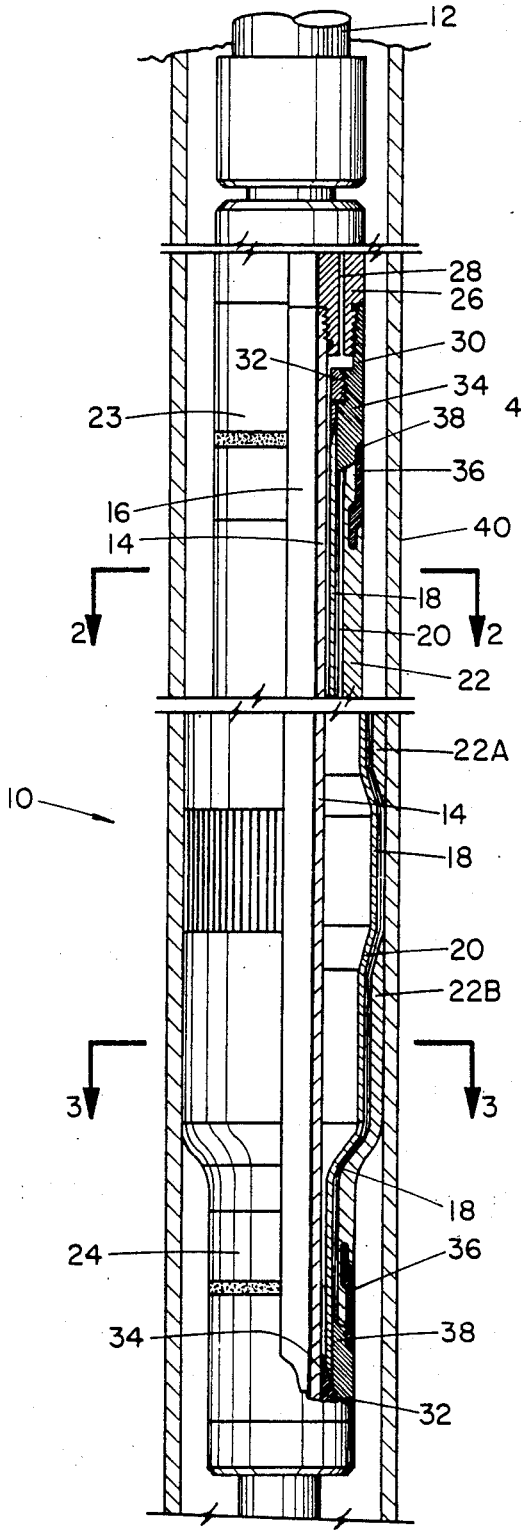
FIG. 1 is a quarter-sectional view of a suitable packer according to the present invention, illustrating the upper portion of the packer in its run in or relaxed position, and illustrating the lower portion of the packer in its inflated or expanded position in sealed engagement with a well casing.

FIG. 1 depicts an inflatable packer 10 according to the present invention. Those skilled in the art recognize that the upper and lower portions of the packer are similar, and accordingly only the upper portion of the packer 10 is shown in its run in or relaxed condition, while the lower portion of the packer 10 is shown in its inflated or expanded position. The packer of the present invention may be passed through a relatively small diameter tubing string in an oil or gas well, and subsequently expanded or set to seal against a larger diameter casing 40. The run in and expanded diameters of the packer will, of course, depend on the particular conditions of the well. Accordingly, the materials for the components of the packer, including particularly the elastomeric materials and seals, will be selected in view of the anticipated temperature and type of fluid in the well at the depth where the packer is to be set.

The packer 10 is conventionally connected to a tubing string 12 for lowering the packer to its desired position within a well. Mandrel 14 extends axially throughout the length of the packer 10, and provides a flow passage 16 of a desired diameter to transmit fluid and/or wireline equipment through the bore of the set packer. Preferably the interior diameter of the mandrel 14 is maximized for a high flow rate of fluid through the set packer and/or so that relatively large diameter equipment may be passed through the packer. The outer diameter of the packer in its unset position is minimized, however, so that the packer may be easily and reliably transmitted through a smaller diameter tubing string (not shown).

The primary functional components of the packer include an elongate, elastomeric, sleeve-like boot or bladder 18, a plurality of elongate, sheet-like metal reinforcing members or strips 20 each positioned radially outward of the bladder 18, and an elongate sleeve-like elastomeric packer cover 22 for sealing engagement with the casing 40. Packer cover 22 may be an elongate continuous sleeve-like member extending substantially from the upper to the lower end of the packer or, as shown in FIG. 1 may comprise separate upper and lower portions 22A and 22B, respectively. The interruption in packer cover 22 thus exposes the reinforcing members 20, as depicted in FIG. 1, so that a portion of the axial length of the reinforcing members may engage the casing 40.

An upper packer head 23 comprising sub 26, sleeve 30, and stress ring 36 is axially fixed to the tubing string 12 and thus to the inner mandrel 14, as shown. The lower packer head 24 comprises similar mirror image components, except that the lower packer head 24 is axially or longitudinally movable with respect to the mandrel 14. Thus the lower packer head 24 moves upward toward the upper packer head 23 as the packer expands, which is conventional for inflatable packers. Except for this difference, the lower and upper packer heads may be identical, so that like numerals are hereafter used to reference like components.

The lower end of sub 26 is threaded to sleeve 30 and sealed with respect thereto. The upper and lower stepped stress rings 36 may each be connected to the sleeve 30 by a weld, which is more fully disclosed in U.S. Pat. No. 4,768,590, herein incorporated by reference. The upper and lower ends of the bladder 18 may be secured to the sleeves 30 by wedge rings 34, which in turn are held in place by nuts 32 attached to the sleeves 30. The sub 26 includes a lengthwise bore 28 into which fluid from the interior of the string 12 can be introduced. This pressurizing fluid will flow past the inner diameters of nut 32 and ring 34, and into the space between the mandrel 14 and the bladder 18 to inflate the bladder and thus the packer. The upper packer head 23 typically includes a valve mechanism (not shown) which seals the pressurized fluid in this annular space so that the packer remains inflated without the need to maintain pressure in the string 12. This valve may be deactivated or other conventional means used to release the pressure in the packer.

Both the upper and lower sleeves 30 include an axially extending portion 38 for securing each of the reinforcing members 20 to the packer heads. According to the present invention, the reinforcing members preferably are fabricated from a steel material, and may be connected to the portion 38 by a weld. The elongate metal reinforcing members 20 extend lengthwise along the packer, and are arranged in an overlapping series progressing circumferentially around the packer to form a full annular layer between the bladder 18 and the packer cover 22.

Figure 2:
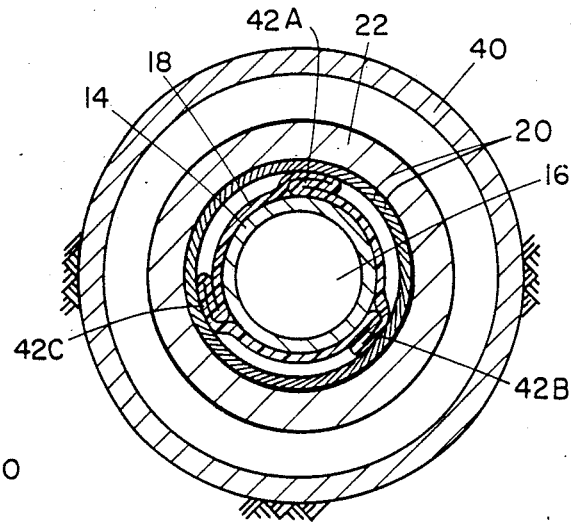
FIG. 2 is a transverse cross-sectional view taken along line 2—2 of FIG. 1, and showing the packer in its relaxed position.
Figure 3:
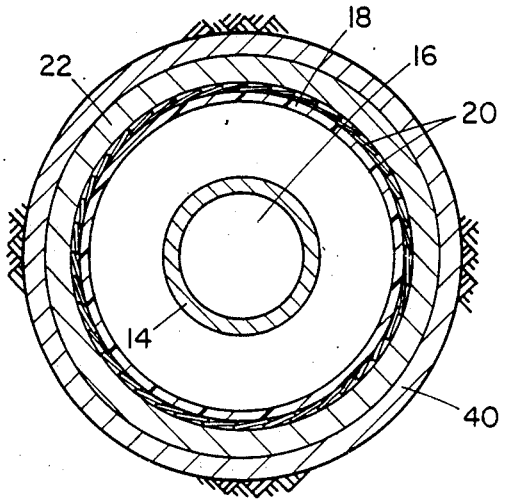
FIG. 3 is a transverse cross-sectional view taken along line 3—3 of FIG. 1, and showing the packer in its inflated position.

FIGS. 2 and 3 depict the packer 10 in its relaxed and expanded positions, respectively. In its relaxed state, the bladder 18 includes a plurality of folded over sections 42A, 42B, and 42C, which allow the bladder to expand radially with at least a portion of the expansion being attributed to the "oversized" bladder. Further details regarding the bladder 18 and the benefits of this bladder are discussed in the referenced U.S. patent. It should be understood that these folded over sections of the bladder disappear when the packer is expanded, as shown in FIG. 3. FIGS. 2 and 3 also generally depict the plurality of overlapping metal reinforcing members 20. Each of the slightly curved and substantially sheet-like reinforcing members 20 would typically be approximately 1.0 inch in width and 0.020 inches in thickness. As shown in FIG. 2, three-fourths to five-eighths of the width of each of the reinforcing members is overlapped by an adjacent reinforcing member when the packer is in its unset position. When the packer is in its set position, as shown in FIG. 3, this overlap is inherently decreased, so that only from three-eighths to one-half inch of the width of each reinforcing member may be overlapped by an adjacent reinforcing member.

Figure 4:
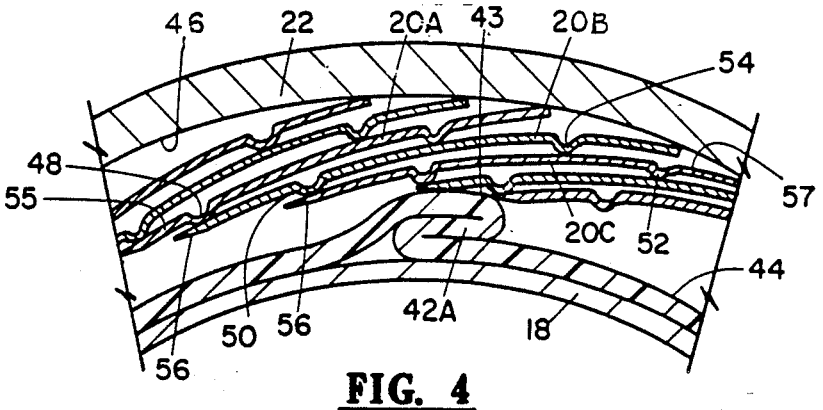
FIG. 4 is an exploded view of a portion of the apparatus depicted in FIG. 2.

FIG. 4 depicts in greater detail a plurality of reinforcing members 20A, 20B, and 20C occupying the annulus between the bladder 18 and the packer cover 22. When the packer is in its relaxed state, the radially outward surface 43 of the fold over portion 42A is in engagement with the inner portion of one or more of the reinforcing members, and the radially inner surface 46 of the packer cover 22 is in engagement with the outer end of the reinforcing members. Each of the reinforcing members 20A, 20B, and 20C are substantially identical, and include a leading side 55 and a trailing side 57. A substantially semi-circular recess 48 is formed in an exterior surface of each reinforcing member (either the radially outward or radially inward surface), and has a depth typically ranging from 0.005 inches to 0.0010 inches. The recess 48 may easily be formed by a stamping operation, so that a similarly shaped ridge 50 projects radially inward from the radially inner surface of the reinforcing member. The trailing side 57 includes a tab 52 projecting radially inward from the radially inner surface of each reinforcing member. Tab 52 may also be formed by a stamping operation, so that another recess 54 is formed in the exterior surface of each reinforcing member. For the reinforcing members depicted in FIGS. 4 and 5, the projection 50 and the recess 54 serve no particular function, since the stop surfaces which limit sliding action of the reinforcing members relative to each other are formed by the tab 52 and the sides of the recess 48 in the adjacent reinforcing member.

Figure 5:
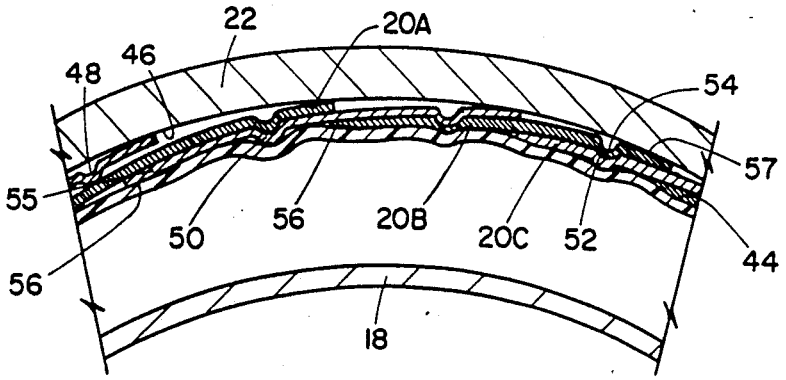
FIG. 5 is an exploded view of a portion of the apparatus depicted in FIG. 3.

In its expanded position, as shown in FIG. 5, tab 52 thus falls within the recess 48 of an adjoining reinforcing member, thereby limiting further sliding movement of these reinforcing members. As shown in FIG. 5, not all of the reinforcing members will necessarily move the same amount with respect to their adjacent reinforcing members, so that the tab 52 of one reinforcing member may be within the recess 48 of an adjacent reinforcing member and thus be prohibited from further sliding movement, while another reinforcing member may still slide (and thus create further radially outward expansion) with respect to its adjacent reinforcing member before it falls within its respective recess. According to the present invention, gaps between reinforcing members are prevented since the amount of sliding movement or circumferential movement between reinforcing members is limited. Accordingly, the stop surfaces on the reinforcing members are positioned at a preselected location to prevent the formation of undesirable gaps between reinforcing members, and preferably to obtain a substantially uniform overlapping of the reinforcing members when the packer is in its set position.

As a further feature of the present invention, leading side 55 of each of the reinforcing members preferably has an interior surface 56 which lies substantially in a tangential plane. The tangential surfaces 56 thus form an essentially cylindrical-shaped configuration, with spacings between the surfaces 56, as shown. These surfaces 56, which may be formed by a honing operation after the reinforcing members are circumferentially positioned in an overlapping relationship and welded to the packer heads, inherently result in an interior surface 56 which is slightly arcuate and is substantially parallel with the adjoining exterior surface 44 of the expanded bladder 18. By honing the reinforcing members to create the tangential surfaces 56, wear on the bladder 18 is substantially minimized, an edge of the reinforcing member is less likely to grab into the bladder 18, and smooth low-frictional expansion of the bladder is enhanced.

FIG. 5 illustrates the relationship of the reinforcing members and the bladder when the packer is in its inflated position. Fluid pressure in the bladder 18 forces the reinforcing members outward, so that very little if any radial gap between the reinforcing members exits (the radial spacing between the reinforcing members in the run-in position is exaggerated in FIG. 4 for clarity). Depending on the width of the reinforcing members and the diameter of the packer, the tip end of the leading side 55 of each of the reinforcing members may be honed such that a substantially knife edge is provided. Alternatively, this tip may be somewhat blunted, as depicted in FIG. 5, to minimize the possibility of cutting the bladder. In either event, the bladder configuration may vary somewhat from a pure cylindrical configuration due to the projections 50, and extrusion of the expanded bladder between radially spaced reinforcing members is preferably eliminated. Equally important, the width of the reinforcing member at the tip edge of the leading side has been substantially reduced by the surface 56, so that the expanded bladder is not undesirably pressed into a sizable "corner" between one reinforcing member and the leading edge of an adjacent reinforcing member.

Figure 6:
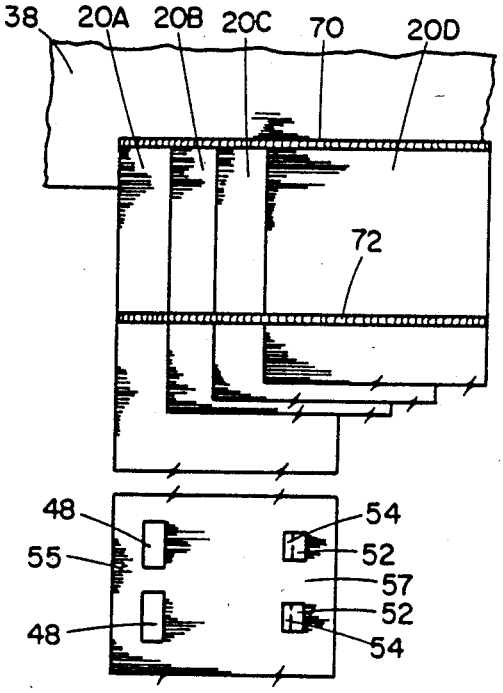
FIG. 6 is a side view of a plurality of reinforcing members secured to an upper packer head.

FIG. 6 depicts a side view of a plurality of reinforcing members 20A, 20B, 20C and 20D each secured to the portion 38 of the sleeve 26 and to other reinforcing members by a pair of axially spaced welds 70 and 72. Weld 70 is at the extreme axial end of each of the reinforcing members, while weld 72 is spaced axially from weld 70 a substantial distance and secures each reinforcing member to an underlying reinforcing member. This axial spacing of the welds 70 and 72 enables more uniform spreading of the reinforcing members during the packer setting operation, thereby further decreasing the likelihood of gaps between reinforcing members. The reinforcing members may be fixedly welded to the upper and lower packer heads at their proper overlapping positions when the packer is in its run in or unset position.

Reinforcing member 20A shown in FIG. 6 includes a pair of recesses 48 as previously described which appear substantially rectangular-shaped from a top view, and a corresponding pair of tabs 52. A limited amount of axial displacement of one reinforcing member with respect to another is possible (either due to manufacturing tolerances or variations caused by assembly), so that the axial length of each of the recesses 48 is preferably substantially greater than the axial length of each of the tabs 52, thereby ensuring that the tab 52 will drop within rather than pass by the recess 48 of an adjacent reinforcing member during expansion of the packer.

As shown in FIG. 6, more than one stop member may be provided on each reinforcing member. Preferably at least two axially spaced stop members are provided on each reinforcing member positioned slightly below the upper packer head and slightly above the lower packer head. Additional stop members may be provided, either spaced generally in the middle of the packer or adjacent the packer heads. Also, the stop member on each reinforcing member may be substantially continuous, i.e. extending axially at least substantially the entire length between the packer heads. The number, axial location and spacing, and the axial length and width of the stop members will depend on the particular design considerations for the inflatable packer, and may be emperically determined.

Figure 7:
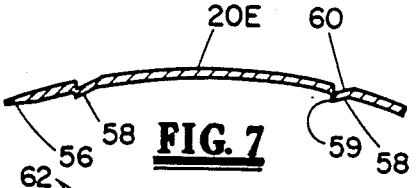
FIG. 7 is a transverse cross-sectional view of another embodiment of a reinforcing member according to the present invention.
Figure 8:
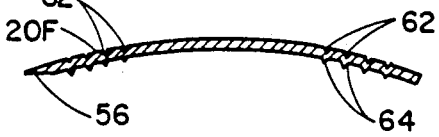
FIG. 8 is a transverse cross-sectional view of still another embodiment of a reinforcing member for a packer according to the present invention.

FIGS. 7 and 8 depict alternate embodiments of a reinforcing members according to the present invention for use in an inflatable packer. Each of the reinforcing members preferably includes a tangential surface 56, as previously discussed. Reinforcing member 20E includes a pair of circumferentially spaced lips 58 which, unlike lip 52, each has one edge sheared from the body of the reinforcing member, thereby forming a relatively sharp corner 59 for acting as a stop surface. A plurality of reinforcing members 20E may thus slide relative to one another until the lip 58 falls within the slot 60 of an adjacent reinforcing member, with slot 60 being formed by the above-described stamping operation. Moreover, the reinforcing member 20E as shown in FIG. 7 has an advantage over the reinforcing members previously discussed, in that the sharp corner 59 of the lip will be able to withstand a strong tangentially-directed force before the lip would jump out of its recess during inflation of the packer.

FIG. 8 depicts still another embodiment of a reinforcing member 20F according to the present invention.

Metal reinforcing members 20F each have a plurality of substantially vertical indentation lines 62 in its radially outer surface at both the left-hand side and right-hand side of the reinforcing member. Indentation lines 62 may be formed by a stamping operation, and result in a series of small gripping teeth 64 projecting radially inward from the radially inner surface of the reinforcing members. The metal reinforcing members are thus permitted to slide relative to one another during expansion of the packer, although this sliding movement is limited by the higher frictional forces which will result when teeth 64 of one of the reinforcing members slides over the indentation lines 62 of an adjacent reinforcing member. The configuration of the reinforcing members as shown in FIG. 8 thus serves to limit or control sliding movement of one reinforcing member relative to another, thereby preventing or substantially minimizing the likelihood of the creation of gaps between reinforcing members during expansion of the packer.

Various modifications of the specific embodiments described above will be suggested from the above disclosure. Although the reinforcing members are preferably fabricated from steel, it should be understood that sheet-like reinforcing members, manufactured from other metallic or plastic materials, such as Kevlar TM, may be employed. Also, the sheet-like reinforcing members may each comprise a plurality of braided cables held together to form a relatively thin elongate strap.

The stop member on each reinforcing member is conveniently formed by forming a notch in each reinforcing member, and by forming a lip on each adjacent reinforcing member intended to fit within the recess to prohibit further sliding movement of the reinforcing members. The stop member may, however, be formed as a radially inwardly directed or radially outwardly directed tab or lip on each reinforcing member, with the tab designed to engage a leading or trailing edge of an adjacent sheet-like reinforcing member. Although the stop surfaces formed by the recesses and the lips may be easily formed by a stamping operation, it should be understood that such stop surfaces may otherwise be secured to the reinforcing members. For example, the stop surface may be formed by a weld or solder bead on the right-hand side of each reinforcing member, which either drops within a groove or engages a similar but radially opposite bead on the left hand side of its adjacent reinforcing member.

Although the packer of the present invention is particularly well suited to include a bladder which has a generally uniform wall thickness, and at least a portion of the bladder being folded upon itself and having an outer diameter greater than the inner diameter of the packer cover when the packer is deflated, it should be understood that a conventional bladder may also be used with the improved reinforcing members as described herein.

The foregoing disclosure and description of the invention is illustrative and explanatory thereof, and various changes in the apparatus described and the details as shown in the figures may be made without departing from the spirit and scope of the invention.

What is claimed is:

1. An inflatable packer for setting downhole in an oil or gas well in response to fluid pressure to prevent fluid flow past the packer, the packer comprising:

an upper packer head and a lower packer head;

an inflatable elastomeric bladder sleeve having upper and lower ends secured to the upper and lower packer heads, respectively;

an inflatable tubular packer cover radially outward of the bladder sleeve and extending axially between and interconnecting the packer heads; and a plurality of radially overlapping metal reinforcing members extending axially between the packer heads and each positioned in an annulus between the bladder sleeve and the tubular packer cover, each reinforcing member have a first leading portion for engaging and reinforcing the inflatable elastomeric bladder sleeve and a second circumferentially spaced trailing portion positioned radially between the first portion of an adjacent reinforcing member and the tubular packer cover, each of the reinforcing members being slidably movable in a substantially tangential direction relative to its adjacent reinforcing member to vary the circumferential spacing between the reinforcing member and the adjacent reinforcing member, each reinforcing member further including a stop member axially positioned between the upper and lower packer heads for limiting to a preselected amount the movement of each reinforcing member in the substantially tangential direction relative to its adjacent reinforcing member during expansion of the packer, such that gaps between reinforcing members and rupture of the bladder are minimized.

2. An inflatable packer as defined in claim 1, further comprising:

a rigid tubular mandrel radially interior of the bladder and having a flow passage therethrough, the mandrel having one end rigidly secured to one of the upper or lower packer heads; and the other of the upper or lower packer heads axially movable with respect to the mandrel during inflation of the packer.

3. An inflatable packer as defined in claim 1, wherein the leading portion of each of the overlapping metal reinforcing members has an interior surface lying substantially within a tangent plane, such that the interior surface is substantially parallel to the outer surface of the bladder sleeve when the packer is inflated.

4. An inflatable packer as defined in claim 1, wherein each of the metal reinforcing members is an elongate substantially sheet-like member which is slidably movable relative to another reinforcing member during inflation of the packer.

5. An inflatable packer as defined in claim 4, wherein each of the metal reinforcing members is welded at each end to a respective upper or lower packer head, and is welded at an axially spaced position to an adjacent reinforcing member.

6. An inflatable packer as defined in claim 4, wherein the stop member comprises a recess in an exterior surface of each sheet-like reinforcing member.

7. An inflatable packer as defined in claim 6, wherein each of the sheet-like reinforcing members includes a lip for fitting within the recess of an adjacent reinforcing member.

8. An inflatable packer as defined in claim 7, wherein the axial length of each of the recesses is greater than the axial length of each of the lips.

9. An inflatable packer for setting downhole in a well to prevent fluid flow past the packer, the packer comprising:

an upper packer head and a lower packer head;

a rigid tubular mandrel having a flow passage therethrough and having one end rigidly secured to one of the upper or lower packer heads;

an inflatable elastomeric bladder sleeve radially outward of the mandrel and having upper and lower ends secured to the upper and lower packer heads, respectively;

an inflatable tubular packer cover radially outward of the bladder sleeve and extending axially between the upper and lower packer heads;

a plurality of radially overlapping elongate sheet-like metal reinforcing strips extending axially between the packer heads and each positioned in an annulus between the bladder sleeve and the tubular packer cover and slidably movable in a substantially tangential direction relative to another reinforcing member during inflation of the packer, each of the metal reinforcing strips being welded at each end to a respective upper or lower packer head and being welded at an axially spaced position to an adjacent reinforcing member; and each metal reinforcing member including a stop surface axially positioned between the upper and lower packer heads for limiting to a preselected amount relative movement of each reinforcing member in the substantially tangential direction relative to the adjacent reinforcing member during expansion of the packer.

10. An inflatable packer as defined in claim 9, wherein each of the overlapping metal reinforcing strips includes a leading portion having an interior surface lying substantially within a tangent plane, such that the interior surface is substantially parallel to the outer surface of the bladder sleeve when the packer is inflated.

11. An inflatable packer as defined in claim 9, wherein the stop surface comprises a recess in an exterior surface of each metal reinforcing strip.

12. An inflatable packer as defined in claim 11, wherein each of the metal reinforcing strips includes a lip for fitting within the recess of an adjacent reinforcing strip.

13. An inflatable packer for setting downhole in a well to prevent fluid flow past the packer, the packer comprising:

an upper packer head and a lower packer head;

a rigid tubular mandrel having a flow passage therethrough, the mandrel having one end rigidly secured to one of the upper or lower packer heads;

an inflatable elastomeric bladder sleeve radially exterior of the mandrel and having upper and lower ends secured to the upper and lower packer heads, respectively, the bladder sleeve having a generally uniform wall thickness;

an inflatable tubular packer cover radially outward of the bladder sleeve and extending axially between and interconnecting the packer heads, the packer cover having an inner diameter less than the outer diameter of the bladder sleeve when the packer is deflated;

a plurality of radially overlapping elongate sheet-like metal reinforcing members axially extending between the packer heads and each positioned in an annulus between the bladder sleeve and the tubular packer cover; and each metal reinforcing member including an internal surface lying substantially within a tangent plane, such that the internal surface is substantially parallel to the outer surface of the bladder sleeve when the packer is inflated, and a recess in an exterior surface thereof forming a stop surface axially positioned between the upper and lower packer heads for limiting to a preselected amount movement of each reinforcing member relative to its adjacent reinforcing member in a substantially tangential direction during expansion of the packer.

14. An inflatable packer as defined in claim 13, wherein the interior surface on each of the overlapping metal strips is formed after the overlapping metal reinforcing members are each secured to the upper and lower packer heads, respectively.

15. An inflatable packer as defined in claim 13, wherein each reinforcing member includes a lip for fitting within the recess of an adjacent reinforcing member.

* * * * *